US009311905B2

(12) United States Patent
Murakami et al.

(10) Patent No.: US 9,311,905 B2
(45) Date of Patent: Apr. 12, 2016

(54) INSTALLATION STRUCTURE FOR ACOUSTIC TRANSDUCER AND MUSICAL INSTRUMENT

(71) Applicant: Yamaha Corporation, Shizuoka-ken (JP)

(72) Inventors: Hiroyuki Murakami, Shizuoka-ken (JP); Yoshiya Matsuo, Shizuoka-ken (JP)

(73) Assignee: Yamaha Corporation, Hamamatsu (JP)

( * ) Notice: Subject to any disclaimer, the term of this patent is extended or adjusted under 35 U.S.C. 154(b) by 0 days.

(21) Appl. No.: 14/813,956

(22) Filed: Jul. 30, 2015

(65) Prior Publication Data

US 2016/0035331 A1 Feb. 4, 2016

(30) Foreign Application Priority Data

Aug. 1, 2014 (JP) ..... 2014-157929

(51) Int. Cl.
*G10H 1/32* (2006.01)
*G10C 1/00* (2006.01)

(52) U.S. Cl.
CPC ... *G10H 1/32* (2013.01); *G10C 1/00* (2013.01)

(58) Field of Classification Search
CPC ..... G10C 3/06; G10C 1/00; G10H 2230/011; G10H 1/32
See application file for complete search history.

(56) References Cited

U.S. PATENT DOCUMENTS

| | | | | |
|---|---|---|---|---|
| 7,085,391 | B1 | 8/2006 | Yamaya | |
| 2007/0028752 | A1* | 2/2007 | McGrew | 84/726 |
| 2008/0127798 | A1* | 6/2008 | Sato et al. | 84/192 |
| 2012/0006185 | A1* | 1/2012 | Mishima et al. | 84/744 |
| 2013/0061733 | A1* | 3/2013 | Ohnishi et al. | 84/174 |
| 2014/0202318 | A1* | 7/2014 | Ohnishi et al. | 84/723 |
| 2015/0163571 | A1* | 6/2015 | Satomi et al. | 84/723 |
| 2015/0163575 | A1* | 6/2015 | Ohnishi | 84/723 |
| 2015/0206514 | A1* | 7/2015 | Ohnishi et al. | 84/723 |

FOREIGN PATENT DOCUMENTS

| | | | |
|---|---|---|---|
| EP | 2 757 552 | A1 | 7/2014 |
| JP | S59-500531 | A | 3/1984 |

(Continued)

OTHER PUBLICATIONS

International Preliminary Report on Patentability and Written Opinion PCT/JP2013/085055 dated Mar. 4, 2014 (5 pages).

(Continued)

*Primary Examiner* — Jeffrey Donels
(74) *Attorney, Agent, or Firm* — Blank Rome LLP

(57) ABSTRACT

An installation structure for an acoustic transducer for vibrating a vibrated body of a musical instrument in a first direction for permitting the vibrated body to generate sounds, including: the acoustic transducer having a main body and a vibrating portion that vibrates in the first direction; a support portion to be fixed to a housing of the musical instrument for supporting the main body; and a cover member fixed to the support portion for covering the acoustic transducer, wherein the support portion includes a base plate portion to be held in surface contact with the housing so as to be fixed thereto, a first fixing portion to which the main body is fixed and which supports the main body, and a second fixing portion to which the cover member is fixed, and wherein the first and second fixing portions are connected to the base plate portion independently of each other.

9 Claims, 8 Drawing Sheets

(56) References Cited

FOREIGN PATENT DOCUMENTS

| | | | |
|---|---|---|---|
| JP | H04-500735 | A | 2/1992 |
| JP | 2000-315088 | A | 11/2000 |
| JP | 2008-298992 | A | 12/2008 |
| JP | 2009-15019 | A | 1/2009 |
| JP | 2012-230406 | A | 11/2012 |
| JP | 2013-77000 | A | 4/2013 |
| TW | 466468 | B | 12/2001 |
| WO | WO 83/03022 | A1 | 9/1983 |
| WO | WO 90/03025 | A1 | 3/1990 |
| WO | WO 00/54250 | A1 | 9/2000 |

OTHER PUBLICATIONS

Non-Final Office Action mailed Nov. 10, 2015 in U.S. Appl. No. 14/762,611.

Extended Search Report for European Patent Application 15178828.8, dated Dec. 17, 2015.

* cited by examiner

INSTALLATION STRUCTURE FOR ACOUSTIC TRANSDUCER AND MUSICAL INSTRUMENT

CROSS REFERENCE TO RELATED APPLICATION

The present application claims priority from Japanese Patent Application No. 2014-157929, which was filed on Aug. 1, 2014, the disclosure of which is herein incorporated by reference in its entirety.

BACKGROUND OF THE INVENTION

1. Field of the Invention

The present invention relates to an installation structure for an acoustic transducer and a musical instrument having the same.

2. Description of Related Art

Various conventional musical instruments such as keyboard musical instruments have an acoustic transducer installed thereon. The acoustic transducer is configured to vibrate a vibrated body such as a soundboard in a predetermined direction so as to permit the vibrated body to generate sounds. Such an acoustic transducer has a main body including a magnetic-path forming portion for forming a magnetic path and a vibrating portion configured to vibrate with respect to the main body of the acoustic transducer.

The following Patent Literature 1 discloses an installation structure for an acoustic transducer in which a main body of the acoustic transducer is fixed to a housing of a musical instrument (e.g., a back post of a grand piano) and one end of a vibrating portion of the acoustic transducer in a vibrating direction is fixed by bonding or the like to the vibrated body. When the vibrating portion is vibrated with respect to the main body (the magnetic-path forming portion), the vibrated body vibrates in a predetermined direction to thereby generate sounds.

Patent Literature 1: JP-A-2013-077000

SUMMARY OF THE INVENTION

In an instance where the thus constructed acoustic transducer is installed on a grand piano, the acoustic transducer is disposed on a lower side of the soundboard in the vertical direction. In this instance, the acoustic transducer is exposed to the exterior, and there may be a risk that the external appearance of the grand piano is impaired.

In view of the above, it may be considered to cover the acoustic transducer installed on the grand piano with a box-shaped cover member. In an instance where the cover member is fixed to the main body of the acoustic transducer, however, vibration of the vibrating portion is transmitted to the cover member via the main body of the acoustic transducer. In this instance, the cover member vibrates, whereby unintended sounds are generated from the cover member. The sounds generated based on vibration of the cover member are not preferable because such sounds are mixed, as noise, with the sounds generated based on vibration of the vibrated body.

It may be considered to fix the cover member to a housing of the grand piano such as a back post. It is, however, unfavorable to additionally provide portions at which the cover member is fixed to the housing.

The invention has been developed in view of the situations described above. It is therefore an object of the invention to provide an installation structure for an acoustic transducer in which vibration of a cover member can be prevented or reduced even when the cover member is fixed to a main body of the acoustic transducer. It is also an object of the invention to provide a musical instrument having such an installation structure for the acoustic transducer.

The object indicated above may be attained according to one aspect of the invention, which provides an installation structure for an acoustic transducer configured to vibrate a vibrated body of a musical instrument in a first direction so as to permit the vibrated body to generate sounds, comprising: the acoustic transducer having a main body and a vibrating portion configured to vibrate in the first direction with respect to the main body; a support portion to be fixed to a housing of the musical instrument so as to support the main body of the acoustic transducer; and a cover member fixed to the support portion so as to cover the acoustic transducer, wherein the support portion includes a base plate portion to be held in surface contact with the housing so as to be fixed thereto, a first fixing portion to which the main body of the acoustic transducer is fixed and which is configured to support the main body, and a second fixing portion to which the cover member is fixed, and wherein the first fixing portion and the second fixing portion are connected to the base plate portion independently of each other.

The object indicated above may be attained according to another aspect of the invention, which provides a musical instrument, comprising: the housing: the vibrated body configured to generate sounds by vibration thereof in the first direction; and the installation structure for the acoustic transducer constructed as described above.

BRIEF DESCRIPTION OF DRAWINGS

The above and other objects, features, advantages and technical and industrial significance of the present invention will be better understood by reading the following detailed description of an embodiment of the invention, when considered in connection with the accompanying drawings, in which.

DETAILED DESCRIPTION OF THE EMBODIMENT

Figure 1:
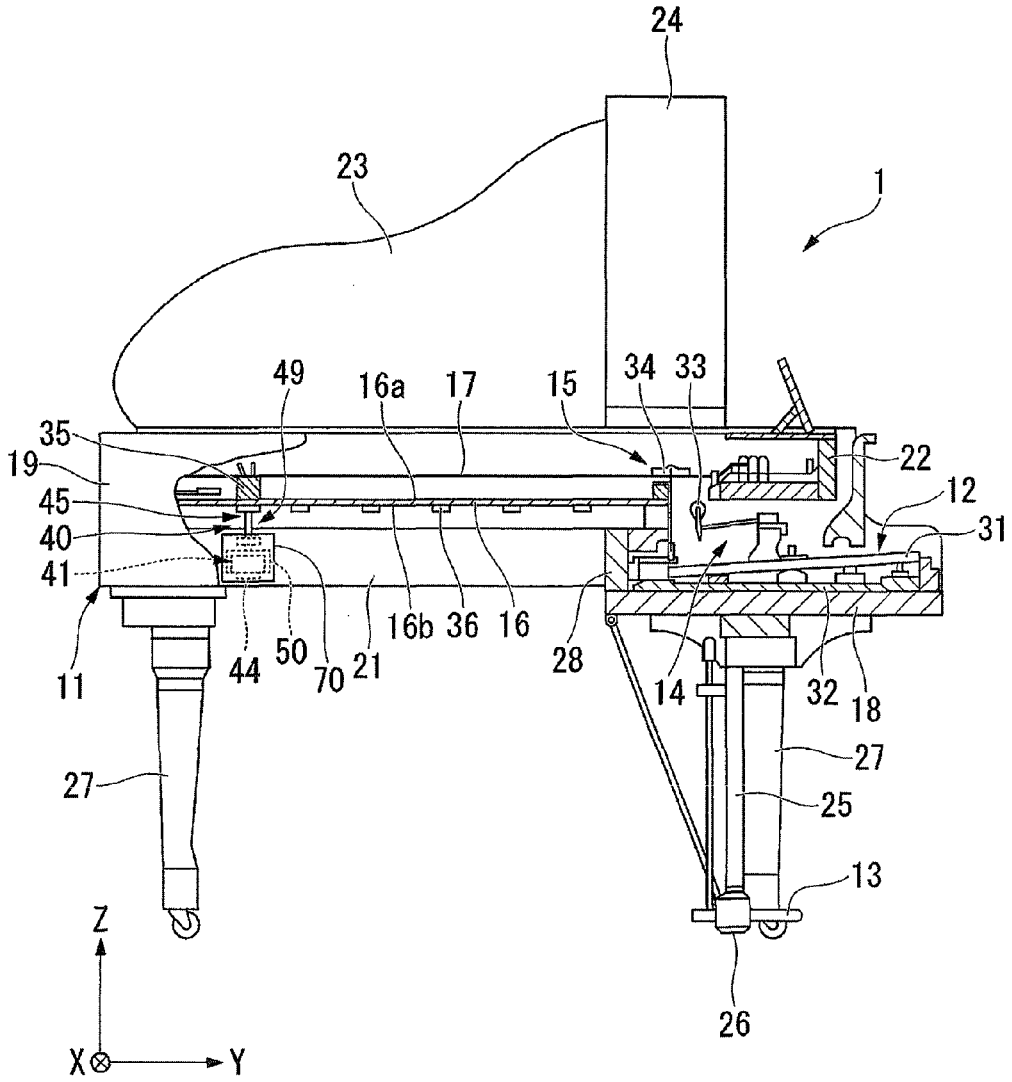
FIG. 1 is a side sectional view showing a piano including an installation structure for an acoustic transducer according to one embodiment of the invention.
Figure 2:
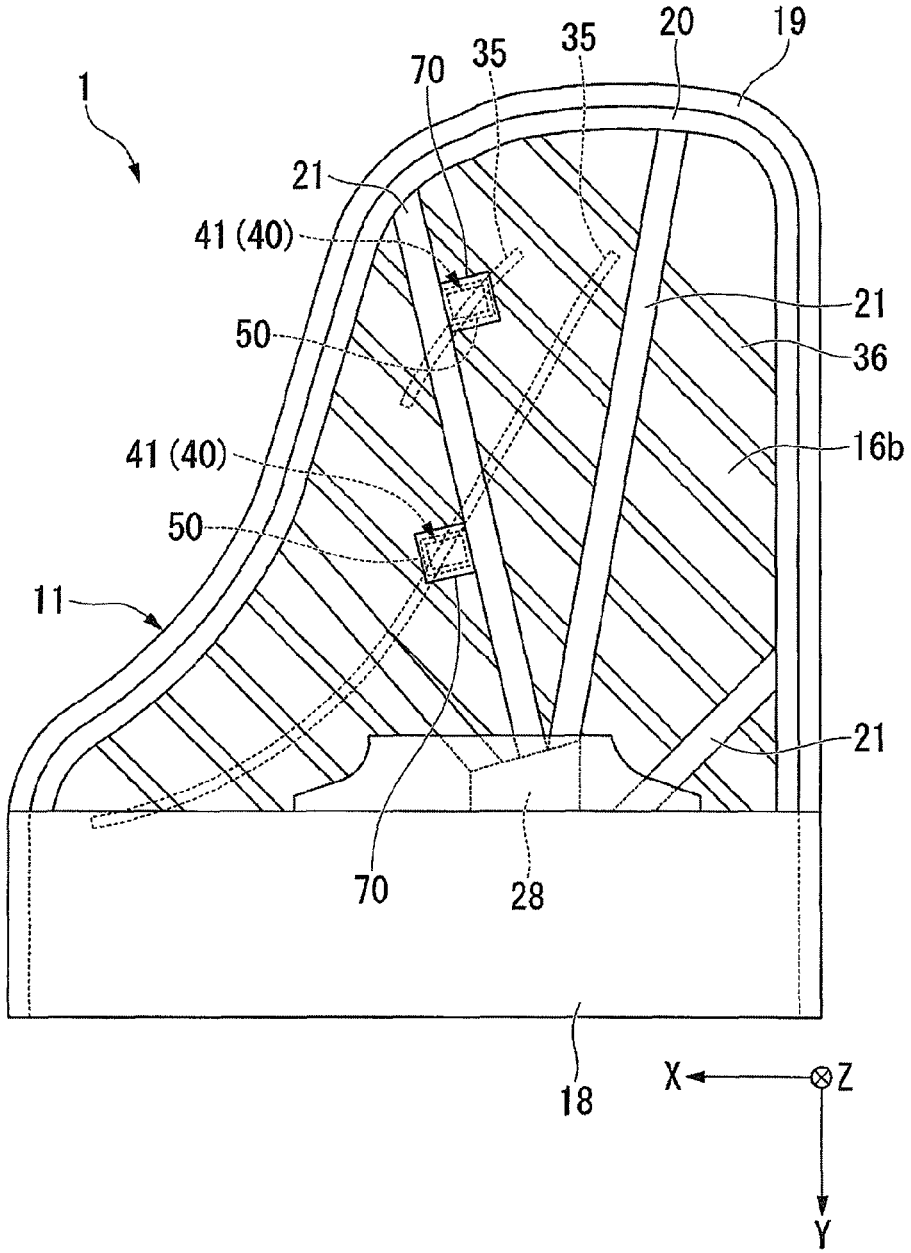
FIG. 2 is a view seen from an underside of the piano of FIG. 1 for explaining positions at which the acoustic transducers are installed.

Referring to FIGS. 1-8, there will be explained one embodiment of the invention. In the present embodiment, a piano 1 which is one of keyboard musical instruments is illustrated as a musical instrument to which is applied an installation structure for an acoustic transducer according to one embodiment of the invention. In FIGS. 1 and 2, a right-left direction and a front-rear direction as seen from a player of the piano 1 are defined as an X-axis direction and a Y-axis direction, respectively. In FIGS. 1-8, an up-down direction as seen from the player of the piano 1 is defined as a Z-axis direction.

As shown in FIGS. 1 and 2, the piano 1 according to the present embodiment is a grand piano which is one sort of an acoustic piano. The piano 1 has a housing 11, a keyboard portion 12, pedals 13, action mechanisms 14, damper mechanisms 15, a soundboard (vibrated body) 16, strings 17, and so on.

The housing 11 includes a key bed 18, an outer rim, an inner rim 20, back posts 21, a front rail 22, a large roof 23, a front roof 24 pivotally connected to a front end of the large roof 23, pedal posts 25, a pedal box 26, and leg posts 27.

The keyboard portion 12 which will be explained is placed on the key bed 18.

The outer rim 19 is fixed to the side edges of the key bed 18 so as to extend rearward of the key bed 18, namely, so as to extend leftward in FIG. 1.

The inner rim 20 is fixed along the inner surface of the outer rim 19. The back posts 21 extend generally in the front-rear direction between the inner rim 20 and a collector 28 fixed to the rear end of the key bed 18. Each back post 21 is disposed at a position near the lower end portion of the outer rim 19. The inner rim 20 and the back posts 21 have a function of permitting the outer rim 19 to have rigidity.

The front rail 22 is disposed above the key bed 18 (i.e., the upper side in FIG. 1) on the front-end side of the outer rim 19 (i.e., the right side in FIG. 1) so as to define a front surface of the housing 11. A part of the key bed 18 protrudes forward of the front rail 22.

The large roof 23 is pivotally connected to the outer rim 19 on the rear side of the front rail 22. The large roof 23 is configured to pivot relative to the outer rim 19, together with the front roof 24, so as to be selectively positioned at one of: a closed position at which the large roof 23 and the front roof 24 are held in contact with the upper end of the outer rim 19 so as to cover an opening above the outer rim 19; and an open position at which the opening is not covered, namely, the opening is exposed to the exterior. In FIG. 1, the large roof 23 and the front roof 24 are placed at the open position.

The pedal posts 25 extend downward on the lower side of the key bed 18. The pedal box 26 is fixed to the distal ends of the pedal posts 25.

The leg posts 27 extend downward from portions of the lower surface of the key bed 18 on the front-surface side of the housing 11, which portions are located on opposite sides of the pedal posts 25 in the right-left direction, and from the lower portions of the inner rim 20 and the back post 21 on the rear-end side of the housing 11.

The keyboard portion 12 has a plurality of keys 31 which are arranged in the right-left direction and which are operated by fingers of a player for performance. Each key 31 is pivotally disposed on the key bed 18 via a key frame 32. The front end portion of each key 31 is exposed to the exterior on the front-surface side of the housing 11 (i.e., the right side in FIG. 1).

The pedals 13 are operating members each of which is operated by a foot of the player and are provided so as to protrude from the front surface of the pedal box 26.

The action mechanism 14 and the damper mechanism 15 are provided for each key 31 and are disposed above the rear end portion of the corresponding key 31. The action mechanism 14 is a mechanism for converting a force by which the key 31 is depressed by a finger of the player (key depression force) into a force by which the string 17 is struck by a hammer 33 (string striking force or the hitting force).

The damper mechanism 15 is a mechanism for converting the key depression force and a force by which a damper pedal (which is one of the pedals 13) is stepped on by a foot of the player (stepping force), into a force by which dampers 34 on the strings 17 are released therefrom (string release force).

The soundboard 16 is disposed on the inner side of the outer rim 19 between the large roof 23 positioned at the closed position and the back posts 21, such that the thickness direction of the soundboard 16 coincides with the up-down direction.

The strings 17 are provided so as to correspond to the keys 31 and are stretched over an upper surface **16*a* of the soundboard 16**.

There are provided, on the upper surface **16*a* of the soundboard 16, bridges 35 partially engaging with the strings 17. There are provided soundboard ribs 36 on a lower surface 16*b* of the soundboard 16 opposed to the back posts 21**.

In the thus constructed piano 1, when one string 17 is struck by the hammer 33 and is accordingly vibrated, the vibration of the one string 17 is transmitted to the soundboard 16 via the bridge 35 and the soundboard 16 is accordingly vibrated. The vibration of the soundboard 16 propagates through the air, so that sounds are generated. That is, the soundboard 16 generates sounds by being vibrated. The vibration of the soundboard 16 is also transmitted to other strings 17 via the bridges 35, so that other strings 17 are vibrated.

The soundboard 16 is vibrated in the thickness direction thereof, namely, in the Z-axis direction. In the following explanation, the direction of the vibration of the soundboard 16 will be referred to as a "predetermined direction" (as one example of a first direction).

The piano 1 of the present embodiment has acoustic transducers 40 configured to vibrate the soundboard 16 in the predetermined direction (the Z-axis direction) so as to cause the soundboard 16 to generate sounds. Hereinafter, the acoustic transducers 40 will be explained referring to FIGS. 3-7.

Figure 3:
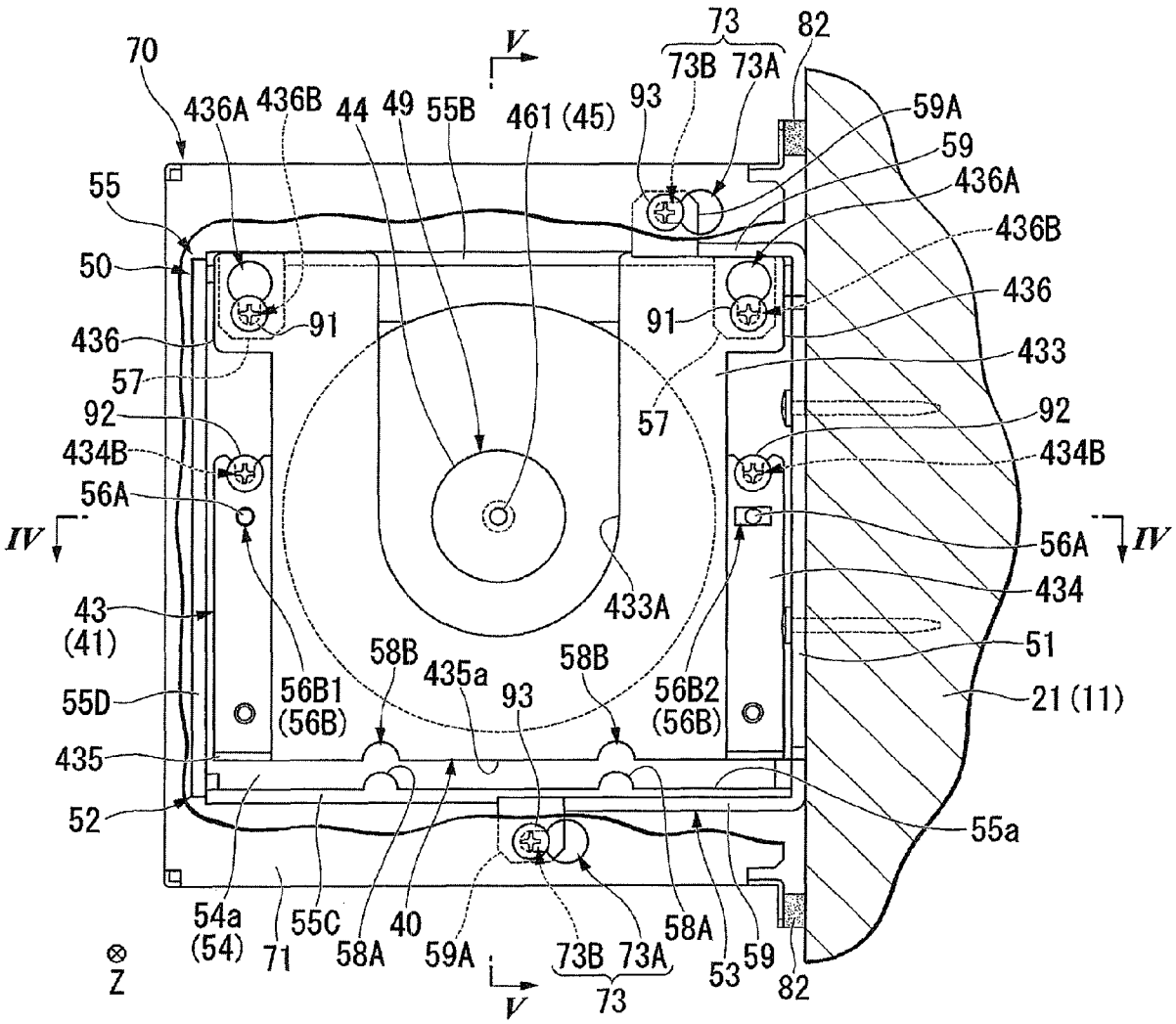
FIG. 3 is an enlarged view seen from the underside of the piano of FIG. 1, the view showing a state in which the acoustic transducer is installed on the piano.
Figure 4:
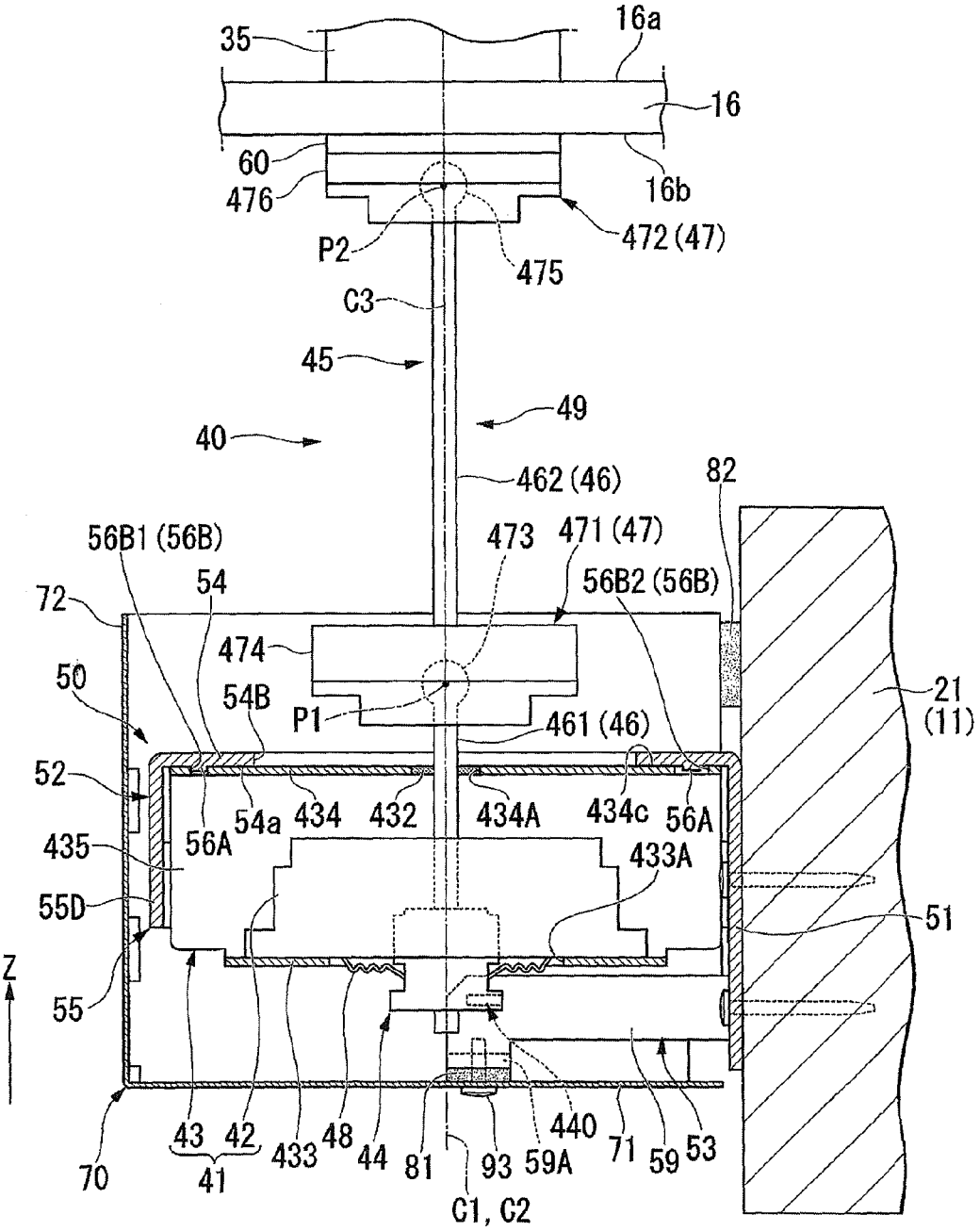
FIG. 4 is a sectional view taken along line IV-IV in FIG. 3.

As shown in FIGS. 3 and 4, the acoustic transducer 40 is an actuator of a voice coil type and includes a main body 41 and a vibrating portion 49.

Figure 6:
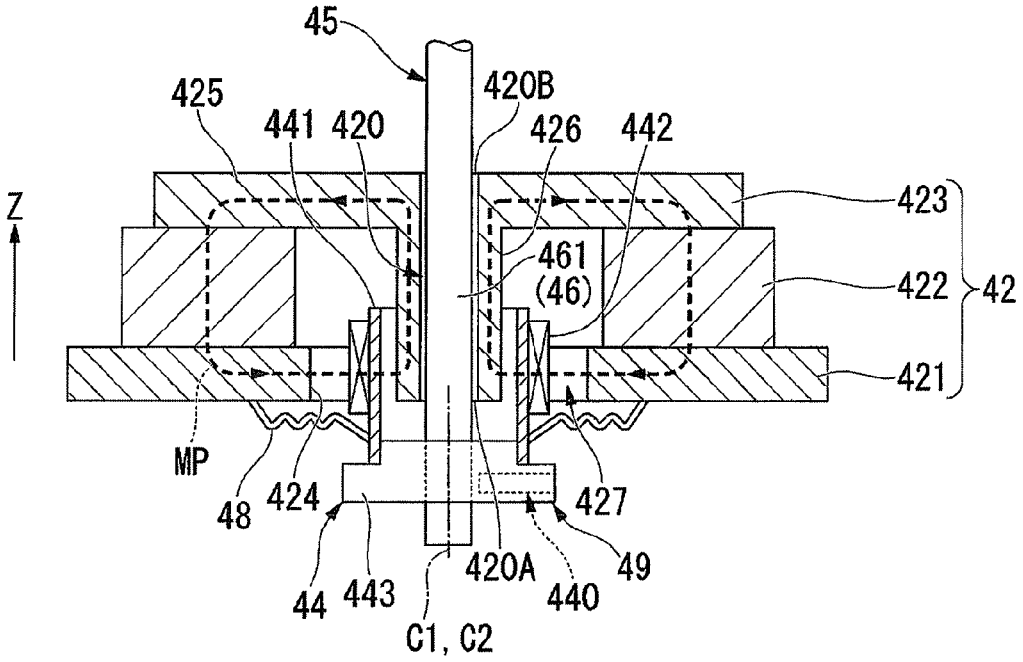
FIG. 6 is a vertical sectional view of a magnetic-path forming portion and a vibrating unit shown in FIGS. 4 and 5.

The main body 41 includes a magnetic-path forming portion 42 for forming a magnetic path. As shown in FIG. 6, an insertion hole 420 is formed through the magnetic-path forming portion 42 in the predetermined direction (the Z-axis direction) for permitting a connecting unit 45 (which will be explained) to pass through the insertion hole 420.

The magnetic-path forming portion 42 of the present embodiment includes a top plate 421, a magnet 422, and a yoke 423.

The top plate 421 is formed of a soft magnetic material such as soft iron. The top plate 421 is shaped like a disc and has a through-hole 424 at its center.

The yoke 423 is formed of a soft magnetic material such as soft iron and is integrally constituted by a disc portion 425 and a cylindrical portion 426 that protrudes from the center of the disc portion 425. The axis of the disc portion 425 and the axis of the cylindrical portion 426 coincide with each other. The cylindrical portion 426 has an outer diameter smaller than an inner diameter of the through-hole 424 of the top plate 421. The above-indicated insertion hole 420 of the magnetic-path forming portion 42 is formed through the disc portion 425 and the cylindrical portion 426 of the yoke 423 in the axis direction thereof.

The magnet 422 is a permanent magnet having an annular shape. The magnet 422 has an inner diameter larger than the inner diameter of the through-hole 424 of the top plate 421.

The magnet 422 is fixed to the disc portion 425 of the yoke 423 in a state in which the cylindrical portion 426 of the yoke 423 passes through the magnet 422. The top plate 421 is fixed to the magnet 422 such that the magnet 422 is sandwiched between the top plate 421 and the disc portion 425 of the yoke 423 and such that the distal end portion of the cylindrical portion 426 is disposed in the through-hole 424 of the top plate 421.

In a state in which the top plate 421, the magnet 422, and the yoke 423 are fixed with one another, the axes thereof coincide with one another and define an axis C1 of the magnetic-path forming portion 42.

In the thus constructed magnetic-path forming portion 42 of the present embodiment, there is formed a magnetic path MP that passes the top plate 421, the cylindrical portion 426, and the disc portion 425 in order from the magnet 422 and returns to the magnet 422. In this arrangement, there is generated, between the inner circumferential surface of the through-hole 424 of the top plate 421 and the outer circumferential surface of the cylindrical portion 426 of the yoke 423, a magnetic field including a component in the diametrical direction of the cylindrical portion 426. That is, a space between the inner circumferential surface of the through-hole 424 of the top plate 421 and the outer circumferential surface of the cylindrical portion 426 of the yoke 423 functions as a magnetic space 427 in which the magnetic field indicated above is generated.

The vibrating portion 49 is connected to the soundboard 16 and vibrates in the predetermined direction (the Z-axis direction) with respect to the magnetic-path forming portion 42. The vibrating portion 49 includes a vibrating unit 44 and the connecting unit 45.

The vibrating unit 44 is configured to vibrate in the predetermined direction (the Z-axis direction) with respect to the magnetic-path forming portion 42. The vibrating unit 44 is disposed on one side of the insertion hole 420 of the magnetic-path forming portion 42 nearer to an opening 420A. The vibrating unit 44 is supported by the magnetic-path forming portion 42 through a damper portion 48. The vibrating unit 44 is removably fixed to the connecting unit 45 by fixing means 440. The vibrating unit 44 of the present embodiment will be explained detail below.

The vibrating unit 44 includes a bobbin 441, a voice coil 442, and a cap 443.

The bobbin 441 has a cylindrical shape. The bobbin 441 in which the cylindrical portion 426 of the magnetic-path forming portion 42 is inserted is inserted in the through-hole 424 of the top plate 421. The axis of the bobbin 441 defines an axis C2 of the vibrating unit 44.

The voice coil 442 is constituted by conductive wires wound around the outer circumferential surface of the bobbin 441 at one end portion of the bobbin 441 in a direction of extension of the axis C2 (hereinafter simply referred to as "axis C2 direction" where appropriate.

The cap 443 is fixed to the bobbin 441 so as to close an opening of the bobbin 441 at the other end portion thereof in the axial direction. The cap 443 is provided with a hole which is formed through the thickness thereof in the axial direction of the bobbin 44 land into which the connecting unit 45 is insertable. The cap 443 is further provided with the above-indicated fixing means 440 for the vibrating unit 44. The fixing means 440 is configured to fix, to the cap 443, the connecting unit 45 inserted in the hole of the cap 443. The fixing means 440 is a chuck device, for instance.

The vibrating unit 44 is attached to the magnetic-path forming portion 42 by the damper portion 48 such that the one end portion of the bobbin 441 around which the voice coil 442 is wound is located in the magnetic space 427 of the magnetic-path forming portion 42 that is formed on the one side of the insertion hole 420 nearer to the opening 420A and such that the other end portion of the bobbin 441 protrudes from the magnetic-path forming portion 42.

The damper portion 48 has a function of supporting the vibrating unit 44 such that the vibrating unit 44 does not contact the magnetic-path forming portion 42. The damper portion 48 further has a function of permitting the axis C2 of the vibrating unit 44 to coincide with the axis C1 of the magnetic-path forming portion 42 and supporting the vibrating unit 44 such that the vibrating unit 44 is displaceable in a direction of extension of the axis C1 of the magnetic-path forming portion 42 with respect to the magnetic-path forming portion 42. (The direction of extension of the axis C1 will be hereinafter simply referred to as "axis C1 direction" where appropriate.)

The damper portion 48 of the present embodiment has an annular shape. The damper portion 48 has a bellows-like shape waved in its diametrical direction. The damper portion 48 is fixed at its inner periphery to the other end portion of the bobbin 441 and at its outer periphery to the top plate 421. The damper portion 48 is formed of a fiber, a resin material, or the like, so as to be elastically deformable.

In the acoustic transducer 40 having the magnetic-path forming portion 42 and the vibrating unit 44 constructed as described above, when an electric current in accordance with an audio signal passes through the voice coil 442 disposed in the magnetic space 427, the vibrating unit 44 vibrates in the axis C1 direction of the magnetic-path forming portion 42. The audio signal is generated in a controller (not shown) as a drive signal for driving the vibrating unit 44, on the basis of audio data stored in a memory (not shown), for instance.

As shown in FIG. 4, the connecting unit 45 connects the vibrating unit 44 and the soundboard 16 to each other so as to transmit vibration of the vibrating unit 44 to the soundboard 16.

The connecting unit 45 of the present embodiment includes: a shaft portion 46 extending between the vibrating unit 44 and the soundboard 16; and a joint portion 47 configured to allow at least a part of the shaft portion 46 to incline with respect to the predetermined direction (the Z-axis direction).

The shaft portion 46 of the present embodiment includes: a rod-like vibrating-side shaft portion 461 that protrudes, toward the soundboard 16, from one side of the acoustic transducer 40 on which the vibrating unit 44 is located; and a rod-like vibrated-side shaft portion 462 that protrudes, toward the vibrating unit 44, from another side of the acoustic transducer 40 on which the soundboard 16 is located. The joint portion 47 of the present embodiment includes: an intermediate joint portion 471 that connects the vibrating-side shaft portion 461 and the vibrated-side shaft portion 462 to each other; and a distal joint portion 472 provided at one axial end of the vibrated-side shaft portion 462 nearer to the soundboard 16.

Figure 5:
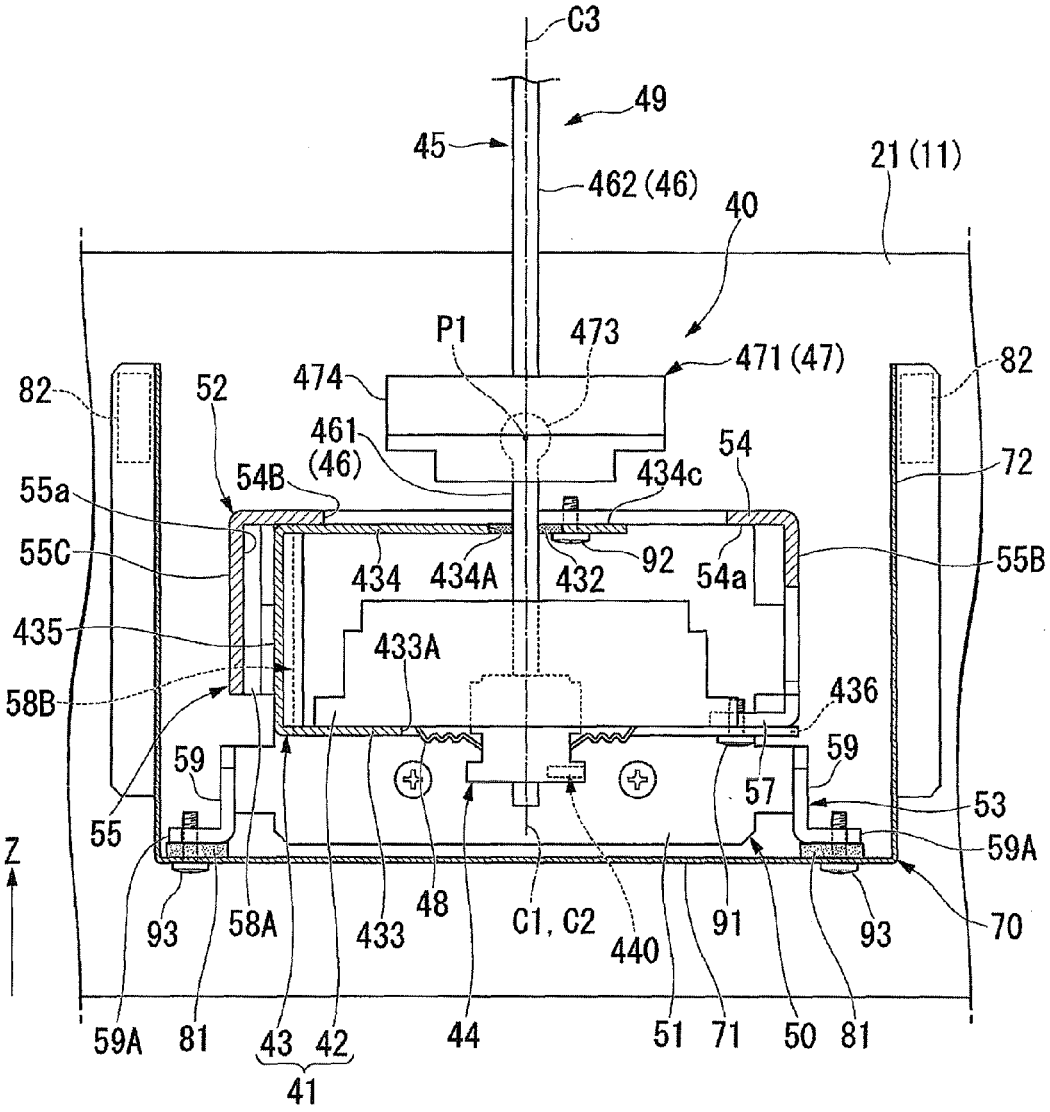
FIG. 5 is a sectional view taken along line V-V in FIG. 3.

As shown in FIGS. 4-6, a first axial end of the vibrating-side shaft portion 461 is removably fixed to the vibrating unit 44 by the fixing means 440. In the present embodiment, the first axial end of the vibrating-side shaft portion 461 is fixed to the cap 443 of the vibrating unit 44 by the fixing means 440 with the first axial end inserted in the insertion hole 420 of the magnetic-path forming portion 42. Thus, the axis of the vibrating-side shaft portion 461 coincides with the axis C2 of the vibrating unit 44. In this state, a second axial end of the vibrating-side shaft portion 461 protrudes from another opening 420B of the insertion hole 420 toward the soundboard 16.

As shown in FIGS. 4 and 5, a first axial end of the vibrated-side shaft portion 462 is connected to the vibrating-side shaft portion 461 via the intermediate joint portion 471. A second axial end of the vibrated-side shaft portion 462 is connected to the soundboard 16 via the distal joint portion 472.

The intermediate joint portion 471 allows the axis C2 of the vibrating-side shaft portion 461 and the axis C3 of the vibrated-side shaft portion 462 to incline relative to each other. The intermediate joint portion 471 of the present embodiment has the so-called ball joint structure.

The intermediate joint portion 471 includes a spherical portion 473 and a retainer portion 474 that rotatably holds the spherical portion 473. In the present embodiment, the spherical portion 473 is formed at the second axial end of the vibrating-side shaft portion 461 while the retainer portion 474 is provided at the first axial end of the vibrated-side shaft portion 462. The spherical portion 473 may be formed at the first axial end of the vibrated-side shaft portion 462 while the retainer portion 474 may be provided at the second axial end of the vibrating-side shaft portion 461. In the present embodiment, a center P1 of the spherical portion 473 is located on the axis C2 of the vibrating-side shaft portion 461.

The center P1 of the intermediate joint portion 471 constructed as described above is located on both of the axis C2 of the vibrating-side shaft portion 461 and the axis C3 of the vibrated-side shaft portion 462. Thus, the axis C2 of the vibrating-side shaft portion 461 and the axis C3 of the vibrated-side shaft portion 462 can incline relative to each other about the center P1 of the intermediate joint portion 471. That is, the connecting unit 45 of the present embodiment is bendable at the intermediate joint portion 471.

As shown in FIG. 4, the distal joint portion 472 allows the axis C3 of the vibrated-side shaft portion 462 to incline relative to the predetermined direction (the Z-axis direction). The distal joint portion 472 has a ball joint structure similar to that of the intermediate joint portion 471.

The distal joint portion 472 includes a spherical portion 475 and a retainer portion 476 similar to those of the intermediate joint portion 471. In the distal joint portion 472 of the present embodiment, the spherical portion 475 is formed at the second axial end of the vibrated-side shaft portion 462 while the retainer portion 476 is fixed to the soundboard 16 via an intervening member 60 (which will be explained). A center P2 of the spherical portion 475 is located on the axis C3 of the vibrated-side shaft portion 462.

That is, the center P2 of the distal joint portion 472 is located on the axis C3 of the vibrated-side shaft portion 462. Thus, the axis C3 of the vibrated-side shaft portion 462 can incline relative to the predetermined direction (the Z-axis direction) about the center P2 of the distal joint portion 472.

As shown in FIGS. 3-5 and 7, the main body 41 of the acoustic transducer 40 of the present embodiment has a restricting holder portion 43 engaging with the vibrating-side shaft portion 461 and configured to restrict a movement of the vibrating-side shaft portion 461 in a direction intersecting the axis C2 direction while allowing a movement of the vibrating-side shaft portion 461 in the axis C2 direction, at a position at which the restricting holder portion 43 engages with the vibrating-side shaft portion 461.

The restricting holder portion 43 includes a frame portion 431 and a contact member 432.

The frame portion 431 is formed by bending a plate member formed of metal or the like. The frame portion 431 includes: a fixing plate portion 433 which is shaped like a flat plate and to which the magnetic-path forming portion 42 is fixed such that the axis C1 direction of the magnetic-path forming portion 42 coincides with the thickness direction of the fixing plate portion 433; an engaging plate portion 434 disposed in parallel with the fixing plate portion 433 such that the magnetic-path forming portion 42 is disposed between the engaging plate portion 434 and the fixing plate portion 433; and a connecting plate portion 435 which extends, on the side portion of the magnetic-path forming portion 42, in the direction of the axis C1 of the magnetic-path forming portion 42 and which connects the fixing plate portion 433 and the engaging plate portion 434 to each other.

Figure 7:
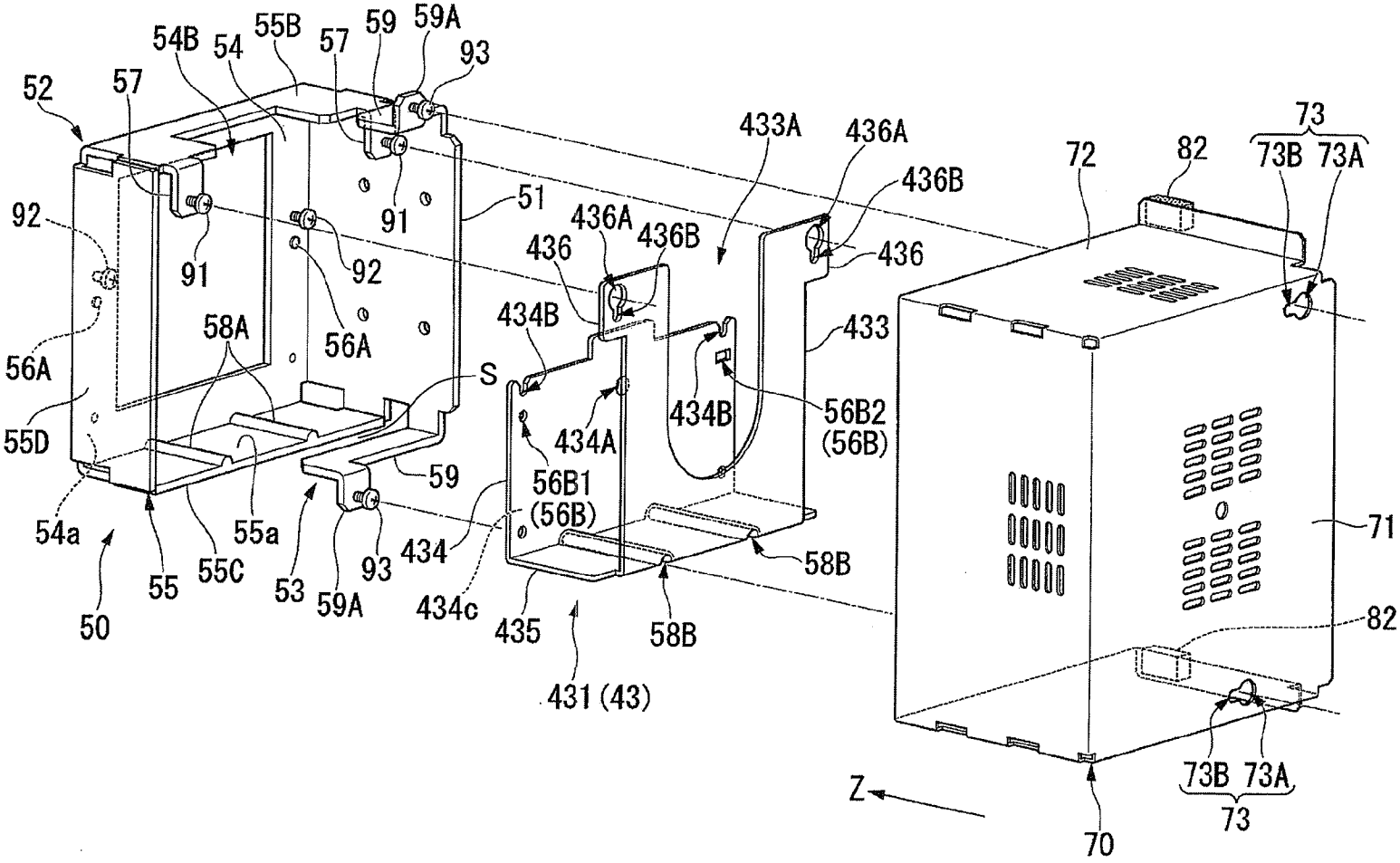
FIG. 7 is an exploded perspective view showing a restricting holder portion, a support portion, and a cover member shown in FIGS. 3-5.

Onto the fixing plate portion 433, one end surface of the magnetic-path forming portion 42 from which the vibrating unit 44 protrudes is superposed and fixed. The fixing plate portion 433 is provided with an opening hole 433A formed through the thickness thereof for preventing the fixing plate portion 433 from interfering with the vibrating unit 44 and the vibrating-side shaft portion 461 that protrude from the magnetic-path forming portion 42. In the present embodiment, the opening hole 433A shown in FIG. 7 is open to the distal end of the fixing plate portion 433 in a direction in which the fixing plate portion 433 extends from the connecting plate portion 435. The opening hole 433A may be open otherwise.

A part of the fixing plate portion 433 is formed as screw-fastening plate portions 436 for fastening the frame portion 431 to a support portion 50 (that will be explained) by first fixing screws 91. Each screw-fastening plate portion 436 is provided with a head insertion hole 436A and a shaft insertion hole 436B which are formed through the thickness of the screw-fastening plate portion 436.

The head insertion hole 436A has an inner diameter larger than a diameter of the head of the first fixing screw 91. The shaft insertion hole 436B has an inner diameter smaller than the diameter of the head of the first fixing screw 91 and larger than a diameter of the shaft of the first fixing screw 91.

The head insertion hole 436A and the shaft insertion hole 436B are formed so as to be continuous to each other in a direction along the major (main) surface of the fixing plate portion 433 (the screw-fastening plate portions 436). In the present embodiment, the head insertion hole 436A is located nearer to the distal end of the fixing plate portion 433 in the extension direction thereof than the shaft insertion holes 436B.

The screw-fastening plate portions 436 extend sideways (i.e., the right-left direction in FIG. 3) from opposite side portions of the fixing plate portion 433 at the distal end of the fixing plate portion 433 in the extension direction thereof. That is, one head insertion hole 436A and one shaft insertion hole 436B are provided on each side portions of the fixing plate portion 433. A width dimension of the fixing plate portion 433 including the screw-fastening plate portions 436 (i.e., a dimension of the fixing plate portion 433 in the right-left direction in FIG. 3) is set to be equal to a width dimension of the engaging plate portion 434 and the connecting plate portion 435. That is, a width dimension of the fixing plate portion 433 without including the screw-fastening plate portions 436 is set to be smaller than the width dimension of the engaging plate portion 434 and the connecting plate portion 435.

The engaging plate portion 434 is disposed between the magnetic-path forming portion 42 fixed to the fixing plate portion 433 and the intermediate joint portion 471 of the connecting unit 45. The engaging plate portion 434 is provided with a hole 434A formed through the thickness thereof for permitting the vibrating-side shaft portion 461 of the connecting unit 45 to pass through the hole 434A. The length of extension of the engaging plate portion 434 from the connecting plate portion 435 is made as small as possible while enabling formation of the hole 434A. That is, the length of extension of the engaging plate portion 434 is set to be smaller than the length of extension of the fixing plate portion 433 from the connecting plate portion 435.

In the present embodiment, the engaging plate portion 434 partly functions as screw-fastening plate portions for fastening the frame portion 431 to the support portion 50 by second fixing screws 92. A shaft insertion hole 434B is formed through each of portions of the engaging plate portion 434 functioning as the screw-fastening plate portion, for permitting the shaft of the second fixing screw 92 to pass therethrough. The shaft insertion hole 434B has an inner diameter smaller than a diameter of the head of the second fixing screw 92 and larger than a diameter of the shaft of the second fixing screw 92.

The shaft insertion holes 434B are open to the edge of the major (main) surface of the engaging plate portion 434. The direction in which the shaft insertion holes 434B are open coincides with a direction in which the shaft insertion holes 436B formed in the fixing plate portion 433 are open with respect to the head insertion holes 436A. In the present embodiment, the shaft insertion holes 434B are open to the distal end of the engaging plate portion 434 in the extension direction thereof from the connecting plate portion 435. The shaft insertion holes 434B are formed at respective side portions of the engaging plate portion 434 that do not overlap the fixing plate portion 433. That is, the shaft insertion holes 434B are provided at widthwise opposite end portions of the engaging plate portion 434 (i.e., the opposite end portions of the engaging plate portion 434 in the right-left direction in FIG. 3).

As shown in FIGS. 4 and 5, the contact member 432 of the restricting holder portion 43 has an annular shape and is formed of a soft fiber member such as felt or cloth. The contact member 432 is fixed by bonding or the like to the inner circumferential surface of the hole 434A of the engaging plate portion 434. The contact member 432 functions as a bushing for filling a clearance between the hole 434A of the engaging plate portion 434 and the vibrating-side shaft portion 461 passing through the hole 434A. That is, the contact member 432 is held in contact with a part of the vibrating-side shaft portion 461 located within the hole 434A of the engaging plate portion 434 and is held in engagement with the vibrating-side shaft portion 461.

The thus configured restricting holder portion 43 restricts a movement of the vibrating-side shaft portion 461 in a direction orthogonal to the axis C2 direction while allowing a movement of the vibrating-side shaft portion 461 in the axis C2 direction, at the position at which the contact member 432 engages with the vibrating-side shaft portion 461.

Referring next to FIGS. 1-5 and 7, the installation structure for installing the acoustic transducer 40 constructed as described above on the piano 1 will be explained.

As shown in FIGS. 1-4, the main body 41 of the acoustic transducer 40 is fixed to the housing 11. The main body 41 is fixed to the housing 11 such that the main body 41 is opposed to the lower surface 16*b* of the soundboard 16 with a spacing left therebetween and such that the axis C2 of the magnetic-path forming portion 42 is parallel to the predetermined direction (the Z-axis direction) orthogonal to the lower surface 16*b* of the soundboard 16.

In the present embodiment, the main body 41 is fixed to the housing 11 via the support portion 50. The support portion 50 is fixed to a side surface of the back post 21 of the housing 11 (i.e., a surface of the back post 21 extending in the Z-axis direction) so as to be disposed between the soundboard 16 and the main body 41, for supporting the main body 41.

As shown in FIGS. 3-5 and 7, the support portion 50 of the present embodiment is formed by bending a plate member formed of metal or the like. The support portion 50 includes a flat base plate portion 51 and a first fixing portion 52.

The base plate portion 51 is fixed to the back post 21 by screwing or the like in a state in which the base plate portion 51 is superposed on the side surface of the back post 21 so as to be held in surface contact therewith.

The main body 41 of the acoustic transducer 40 is fixed to and supported by the first fixing portion 52. The first fixing portion 52 extends, with respect to the base plate portion 51, in a direction away from the side surface of the back post 21 (as one example of a second direction intersecting the Z-axis direction).

The first fixing portion 52 includes: a flat positioning plate portion 54 disposed between the soundboard 16 and the main body 41; and a surrounding plate portion 55 that extends from the periphery of the positioning plate portion 54 in the vertically downward direction (i.e., toward a negative side in the Z-axis direction) so as to cooperate with the base plate portion 51 to surround the main body 41.

The positioning plate portion 54 is disposed so as to be parallel with the soundboard 16. A surface of the positioning plate portion 54 facing vertically downward is a contact surface 54*a* with which the main body 41 of the acoustic transducer is held in surface contact. The engaging plate portion 434 of the frame portion 431 of the main body 41 is held in surface contact with the contact surface 54*a* of the positioning plate portion 54. It is thus possible to position the main body 41 with respect to the housing 11 and the soundboard 16 in the predetermined direction (the Z-axis direction).

The positioning plate portion 54 is provided with an opening hole 54B formed through the thickness thereof for permitting the connecting unit 45 of the acoustic transducer 40 to pass through the opening hole 54B.

The second fixing screws 92 are screwed in the positioning plate portion 54 in a direction toward the contact surface 54*a* from the negative (lower) side in the Z-axis direction. The second fixing screws 92 are for screwing the engaging plate portion 434 to the positioning plate portion 54 in a state in which the engaging plate portion 434 is held in surface contact with the contact surface 54*a*. The two second fixing screws 92 are disposed in a direction of extension of the first fixing portion 52 with respect to the base plate portion 51 (i.e., the right-left direction in FIG. 3). A spacing distance between the two second fixing screws 92 is the same as a spacing distance between the two shaft insertion holes 434B formed in the engaging plate portion 434.

In the structure described above, the shafts of the respective second fixing screws 92 are inserted into the respective shaft insertion holes 434B of the engaging plate portion 434, whereby the engaging plate portion 434 can be fastened to the positioning plate portion 54 by the second fixing screws 92. The shaft insertion holes 434B of the engaging plate portion 434 are open to the distal end of the engaging plate portion 434 in the extension direction thereof. It is thus possible to insert the shafts of the second fixing screws 92, which are screwed in advance in the positioning plate portion 54, into the respective shaft insertion holes 434B of the engaging plate portion 434 by moving the engaging plate portion 434 in a direction along the contact surface 54*a* in a state in which the engaging plate portion 434 is held in contact with the contact surface 54*a*.

The positioning plate portion 54 is provided with positioning engaging portions configured to engage with the main body 41 of the acoustic transducer 40 in a state in which the main body 41 is held in surface contact with the contact surface 54*a*, so as to prevent the main body 41 from moving along the contact surface 54*a*. That is, the positioning engaging portions have a function of positioning the main body 41 with respect to the housing 11 and the soundboard 16 in an orthogonal direction that is orthogonal to the predetermined direction (the Z-axis direction).

In the present embodiment, the positioning engaging portions are positioning protrusions 56A that protrude from the positioning plate portion 54. A plurality of positioning protrusions 56A are provided. In the illustrated embodiment, like the second fixing screws 92, two positioning protrusions 56A are provided so as to be arranged in the direction of extension of the first fixing portion 52 with respect to the base plate portion 51. Each of the illustrated positioning protrusions 56A has a circular shape in plan view. The positioning protrusions 56A may have any shape such as a polygonal shape and a semicircular shape, in plan view.

The main body 41 of the acoustic transducer 40 that is held in surface contact with the contact surface 54*a* of the positioning plate portion 54 is provided with positioning engaged portions corresponding to the positioning engaging portions. In the present embodiment, the positioning engaged portions are positioning holes 56B. The positioning holes 56B are recessed from a contacted surface 434*c* of the engaging plate portion 434 that is held in surface contact with the contact surface 54*a* of the positioning plate portion 54, and the positioning protrusions 56A of the positioning plate portions 54 are fitted into the positioning holes 56B. In the present embodiment, the positioning holes 56B are formed through the thickness of the engaging plate portion 434.

The number of the positioning holes 56B formed in the engaging plate portion 434 corresponds to the number of the positioning protrusions 56A formed on the positioning plate portion 54. In the illustrated embodiment, two positioning holes 56B are formed so as to arranged in the width direction of the engaging plate portion 434, like the shaft insertion hole 434B.

Each positioning hole 56B may have a shape in plan view that corresponds to a shape in plan view of each positioning protrusion 56A, such as a circular shape. The positioning hole 56B may be formed otherwise. In the present embodiment, a first positioning hole 56B1 has a circular shape in plan view corresponding to the positioning protrusion 56A while a second positioning hole 56B2 is an elongated hole having a larger dimension in a direction of arrangement of the positioning holes 56B1, 56B2 than each of the two positioning protrusions 56A. In this structure, even when there is a difference between a spacing between the two positioning protrusions 56A and a spacing between the two positioning holes 56B, it is possible to insert the positioning protrusions 56A into the corresponding positioning holes 56B.

The locations of the positioning protrusions 56A on the positioning plate portion 54 and the locations of the positioning holes 56B in the engaging plate portion 434 are determined such that the positioning protrusions 56A are inserted in the respective positioning holes 56B in a state in which the shafts of the second fixing screws 92 screwed in the positioning plate portion 54 are inserted in the respective shaft insertion holes 434B of the engaging plate portion 434.

The surrounding plate portion 55 of the first fixing portion 52 has threaded plate portions 57 to which the first fixing screws 91 are screwed. Each threaded plate portion 57 extends inward of the surrounding plate portion 55 from its distal end in its extension direction, such that the threaded plate portion 57 is opposed to and parallel to the positioning plate portion 54. The screw-fastening plate portions 436 of the fixing plate portion 433 of the main body 41 contact the respective threaded plate portions 57 in the direction toward the contact surface 54*a* from the negative (lower) side in the Z-axis direction in a state in which the engaging plate portion 434 of the main body 41 is in contact with the contact surface 54*a* of the positioning plate portion 54.

The first fixing screws 91 are screwed in the threaded plate portions 57 in the direction toward the contact surface 54*a* from the negative (lower) side in the Z-axis direction. Like the second fixing screws 92, the two first fixing screws 91 are disposed so as to be arranged in the extension direction of the first fixing portion 52 with respect to the base plate portion 51 (i.e., the right-left direction in FIG. 3). A spacing distance between the two first fixing screws 91 is the same as a spacing distance between the two head insertion holes 436A and between the two shaft insertion holes 436B formed in the fixing plate portion 433.

The locations of the first fixing screws 91 in the first fixing portion 52 are determined such that the shafts of the first fixing screws 91 are inserted in the respective shaft insertion holes 436B of the fixing plate portion 433 in a state in which the shafts of the second fixing screws 92 are inserted in the respective shaft insertion holes 434B of the engaging plate portion 434.

In the structure described above, the fixing plate portion 433 can be fastened to the threaded plate portions 57 by means of the first fixing screw 91 by inserting the shafts of the first fixing screws 91 into the shaft insertion holes 436B of the fixing plate portion 433.

In the fixing plate portion 433, the head insertion holes 436A are formed so as to be continuous to the shaft insertion holes 436B. In a state in which the heads of the first fixing screws 91, which are screwed in advance in the respective threaded plate portions 57, are inserted in the respective head insertion holes 436A and the fixing plate portion 433 is thereby held in contact with the threaded plate portions 57, namely, in a state in which the engaging plate portion 434 is held in contact with the contact surface 54*a*, the main body 41 is moved with respect to the support portion 50 in the direction along the contact surface 54*a*, whereby the shafts of the first fixing screws 91 can be inserted into the respective shaft insertion holes 436B of the fixing plate portion 433.

The shafts of the first fixing screws 91 are inserted into the respective shaft insertion holes 436B of the fixing plate portion 433, whereby the positioning protrusions 56A of the positioning plate portion 54 are inserted into the respective positioning holes 56B of the engaging plate portion 434. That is, the positioning engaging portions of the support portion 50 come into engagement with the main body 41.

The support portion 50 of the present embodiment further includes a guide surface 55*a* formed so as to extend in a direction orthogonal to the contact surface 54*a*. The guide surface 55*a* guides the main body 41 such that the head insertion holes 436A overlap, in the axial direction, the respective first fixing screws 91 screwed in the support portion 50.

In the present embodiment, the guide surface 55*a* of the support portion 50 is provided by a part of an inner surface of the surrounding plate portion 55 of the first fixing portion 52. Specifically, the guide surface 55*a* is provided by an inner surface region of the surrounding plate portion 55 that is opposed to another inner surface region of the surrounding plate portion 55 corresponding to the portions at which the first fixing screws 91 are disposed, in a direction orthogonal to both of the axial direction (the Z-axis direction) of the first fixing screws 91 and the direction in which the two first fixing screws 91 are arranged.

In the present embodiment, the direction in which the head insertion hole 436A and the shaft insertion hole 436B of the main body 41 are arranged or are continuous to each other is orthogonal to the guide surface 55*a*. In particular, the head insertion holes 436A of the main body 41 are more distant from the guide surface 55*a* than the shaft insertion holes 436B. Consequently, when the main body 41 is moved with respect to the support portion 50 such that the shafts of the first fixing screws 91 are inserted into the respective shaft insertion holes 436B of the fixing plate portion 433 after the heads of the first fixing screws 91 screwed in the support portion 50 have been inserted into the respective head insertion holes 436A of the main body 41, the main body 41 is moved away from the guide surface 55*a*.

The guide surface 55*a* has rails 58A extending in the axial direction of the first fixing screws 91 (the second fixing screws 92) screwed in the support portion 50. A guided surface 435*a* of the main body 41 that is to contact the guide surface 55*a* has sliding portions 58B configured to slide in the longitudinal direction of the rails 58A. In the illustrated embodiment, each rail 58A is in the form of a protrusion that protrudes from the guide surface 55*a* while each sliding portion 58B is in the form of a recess that is recessed from the guided surface 435*a*. The rails 58A and the sliding portions 58B may be formed otherwise.

In the present embodiment, the positioning plate portion 54 of the first fixing portion 52 has a rectangular shape in plan view. The surrounding plate portion 55 is constituted by three flat plate portions 55B, 55C, 55D extending respectively from three sides of the positioning plate portion 54 in the vertically downward direction (toward the negative side in the Z-axis direction). The threaded plate portions 57 are provided on one of the three flat plate portions 55B, 55C, 55D, namely, a first flat plate portion 55B that extends in a direction away from the base plate portion 51. The two first fixing screws 91 screwed in the threaded plate portions 57 are disposed at respective positions in the first flat plate portion 55B so as to be spaced apart from each other in the direction away from the base plate portion 51.

The guide surface 55*a* of the support portion 50 is provided by an inner surface of one of the three flat plate portions 55B, 55C, 55D, namely, a second flat plate portion 55C which extends in the direction away from the base plate portion 51 and which is opposed to the first flat plate portion 55B. The guided surface 435*a* of the main body 41 is provided by the connecting plate portion 435 of the frame portion 431.

As shown in FIGS. 1 and 4, the vibrating portion 49 of the acoustic transducer 40 is connected to the lower surface 16*b* of the soundboard 16. The position at which the vibrating portion 49 is connected to the soundboard 16 is preferably determined to be a position at which the soundboard 16 is sandwiched by and between the vibrating portion 49 and the bridge 35 provided on the upper surface 16*a* of the soundboard 16, for instance.

In the present embodiment, the retainer portion 476 of the distal joint portion 472 of the connecting unit 45 is connected to the lower surface 16*b* of the soundboard 16, as shown in FIG. 4. Further, the intervening member 60 is provided between the retainer portion 476 and the soundboard 16, and the retainer portion 476 is fixed to the soundboard 16 via the intervening member 60.

The intervening member 60 is undetachably fixed to the soundboard 16 by bonding or the like and is detachably fixed to the connecting unit 45 (the retainer portion 476) by screwing or the like. The intervening member 60 is shaped like a plate and is disposed such that the thickness direction of the intervening member 60 coincides with the predetermined direction (the Z-axis direction).

A protruding portion and a recessed portion (both not shown) that are to be brought into engagement with each other are formed in one and the other of mutually facing surfaces of the intervening member 60 and the retainer portion 476, whereby the retainer portion 476 of the connecting unit 45 is positioned with respect to the intervening member 60 in the direction orthogonal to the predetermined direction (the Z-axis direction).

As shown in FIGS. 3-5 and 7, the installation structure for the acoustic transducer 40 according to the present embodiment has a cover member 70 that covers the acoustic transducer 40 fixed to the housing 11 via the support portion 50, and so on.

The cover member 70 includes: a bottom plate portion 71 that covers the underside, in the vertical direction, of the acoustic transducer 40; and a side plate portion 72 that extends from a peripheral edge of the bottom plate portion 71 in the vertically upward direction (toward the positive side in the Z-axis direction so as to cover the side portion of the acoustic transducer 40 (the main body 41, in particular). The cover member 70 is shaped like a box opening in the vertically upward direction and in one side portion thereof. The opening of the cover member 70 at its one side portion is closed by the side surface of the back post 21 of the housing 11. In the illustrated cover member 70, the bottom plate portion 71 has a rectangular shape in plan view and the side plate portion 72 is constituted by three flat plate portions respectively extending from three sides of the bottom plate portion 71 in the vertically upward direction. The cover member 70 may be formed otherwise.

The cover member 70 is fixed to the support portion 50. In the present embodiment, the cover member 70 is fixed to a second fixing portion 53 of the support portion 50. Further, the cover member 70 is detachably fixed to the support portion 50 by screwing.

The second fixing portion 53 and the first fixing portion 52 are connected to the base plate portion 51 independently of each other. As shown in FIG. 7, the first fixing portion 52 and the second fixing portion 53 are connected to the base plate portion 51 so as to form a space S therebetween in the Z-axis direction, in other words, with the space S interposed therebetween in the Z-axis direction, so that the first fixing portion 52 and the second fixing portion 53 are connected to the base plate portion 51 independently of each other. The second fixing portion 53 extends from a second position that is distant, by a suitable distance in the vertically downward direction, from a first position at which the first fixing portion 52 is fixed to the base plate portion 51. Specifically, the second fixing portion 53 extends from the second position of the base plate portion 51 in the direction away from the side surface of the back post 21. (The direction is one example of the second direction intersecting the first direction.) In other words, the first fixing portion 52 extends from the first position of the base plate portion 51, and the second fixing portion 53 extends from the second position of the base plate portion 51 different from the first position. The second position of the base plate portion 51 is different from the first position in the predetermined direction (the Z-axis direction). The space S is accordingly formed between a lower end of the first fixing portion 52 and an upper end of the second fixing portion 53, and the first fixing portion 52 and the second fixing portion 53 extend in the direction away from the side surface of the back post 21.

In the present embodiment, the second fixing portion 53 is constituted by a pair of plate-like extending portions 59 formed integrally with lateral portions of the base plate portion 51.

Each plate-like extending portion 59 is a strip-like plate extending from the lateral (side) portions of the base plate portion 51 in the direction away from the back post 21. There are formed, at distal ends of the respective plate-like extending portions 59 in the extension direction thereof, fixing plate portions 59A through which the cover member 70 is fixed to the support portion 50. The fixing plate portions 59A are disposed in parallel with the positioning plate portions 54 of the first fixing portion 52. To each of the fixing plate portions 59A, a third fixing screw 93 for fastening the cover member 70 is screwed from one side of the positioning plate portion 54 on which the contact surface 54*a* is located.

In the present embodiment, the bottom plate portion 71 of the cover member 70 is fastened to the second fixing portion 53 by the third fixing screws 93. To this end, screw insertion holes 73 are formed through the thickness of the bottom plate portion 71 of the cover member 70 for permitting the third fixing screws 93 to pass therethrough.

In the present embodiment, elastically deformable first cushion members 81 are provided between the cover member 70 and the second fixing portion 53. Further, the cover member 70 is pressed onto the housing 11 via elastically deformable second cushion members 82. These cushion members 81, 82 are formed of urethane foam, for instance.

In the present embodiment, one first cushion member 81 is provided between the bottom plate portion 71 of the cover member 70 and one fixing plate portion 59A of the second fixing portion 53, and another first cushion member 81 is provided between the bottom plate portion 71 and another fixing plate portion 59A. The second cushion members 82 are disposed between the opening at the one side portion of the cover member 70 and the back post 21 of the housing 11. In the present embodiment, the screw insertion holes 73 of the cover member 70 are designed such that the second cushion members 82 are sandwiched between the cover member 70 and the housing 11.

Specifically, each screw insertion hole 73 is constituted by a head insertion hole 73A and a shaft insertion hole 73B that are continuous to each other. The head insertion hole 73A has an inner diameter larger than a diameter of the head of the third fixing screw 93, and the shaft insertion hole 73B has an inner diameter smaller than the diameter of the head of the third fixing screw 93 and larger than a diameter of the shaft of the third fixing screw 93. Each head insertion hole 73A is located nearer to the opening at the one side portion of the cover member 70 than the shaft insertion hole 73B.

In the structure described above, when the cover member 70 is moved toward the housing 11 (the back post 21) such that the shafts of the third fixing screws 93 are inserted into the respective shaft insertion holes 73B of the screw insertion holes 73 after the heads of the third fixing screws 93 screwed in the second fixing portion 53 have been inserted into the respective head insertion holes 73A of the screw insertion holes 73, the cover member 70 is pressed onto the housing 11 via the second cushion members 82.

There will be next explained one example of a method of installing the acoustic transducer 40 of the present embodiment on the piano 1.

In the method of the present embodiment, the main body 41 and the support portion 50 constructed as described above are prepared in advance. Initially, a step of fixing the support portion for fixing the support portion 50 to the housing 11 is performed. In this step, the base plate portion 51 is superposed on the side surface of the back post 21 and is fixed to the back post 21 by screwing or the like.

In a state after the step of fixing the support portion has been performed, the contact surface 54*a* of the support portion 50 (the positioning plate portion 54) faces vertically downward (toward the negative side in the Z-axis direction). Further, the first fixing portion 52 of the support portion 50 including the contact surface 54*a* is located at a higher position than the second fixing portion 53 in the vertical direction.

A step of fixing the intervening member for fixing the intervening member 60 to the soundboard 16 is performed before or after the step of fixing the support portion. In this step, the intervening member 60 is fixed to the lower surface 16*b* of the soundboard 16 preferably by one of or both of bonding and screwing, for instance.

In one of the step of fixing the support portion and the step of fixing the intervening member that is later performed, the support portion 50 and the intervening member 60 are preferably positioned relative to each other using a jig not shown. In particular, the support portion 50 and the intervening member 60 are preferably positioned relative to each other in the direction orthogonal to the predetermined direction (the Z-axis direction), namely, in the X-axis direction and the Y-axis direction in FIGS. 1 and 2.

Subsequently, a step of fixing the acoustic transducer for fixing the acoustic transducer 40 with respect to the intervening member 60 and the support portion 50 is performed.

In the present embodiment, the vibrating portion 49 includes the vibrating unit 44 and the connecting unit 45 that are mutually separable. Thus, in the step of fixing the acoustic transducer, there is first performed a step of fixing the connecting unit for fixing the connecting unit 45 of the vibrating portion 49 to the intervening member 60. In this step, the retainer portion 476 of the distal joint portion 472 is initially disposed so as to be positioned relative to the intervening member 60. As described above, the protruding portion and the recessed portion (both not shown) configured to engage with each other are formed in one and the other of the mutually facing surfaces of the intervening member 60 and the retainer portion 476. It is thus possible to position the retainer portion 476 relative to the intervening member 60. The retainer portion 476 is then fastened to the intervening member 60 by screwing. In a state after this step has been performed, the vibrating-side shaft portion 461 of the connecting unit 45 passes through the opening hole 54B of the positioning plate portion 54 of the support portion 50.

In the step of fixing the acoustic transducer, there is performed a step of fixing the main body for fixing the main body 41 of the acoustic transducer 40 to the support portion 50 after the step of fixing the connecting unit. In a period from before the step of fixing the support portion to before the step of fixing the main body, the first fixing screws 91 and the second fixing screws 92 are screwed in the respective corresponding portions of the support portion 50. In the step of fixing the main body, the following first through third mounting steps are performed in order.

Figure 8:
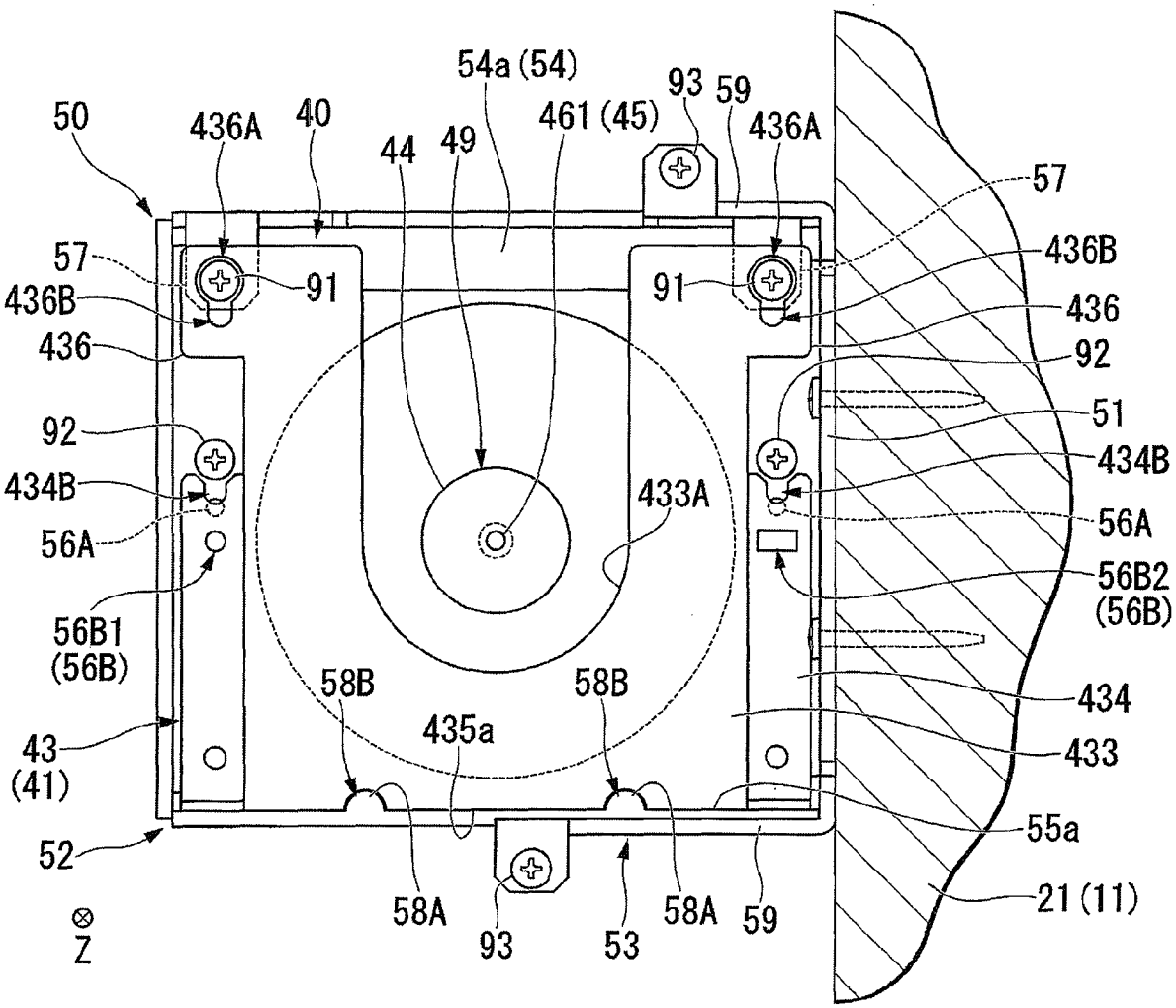
FIG. 8 is a view seen from the underside of the piano for explaining a procedure of mounting the restricting holder portion shown in FIGS. 3-5, and 7 onto the support portion.

In the first mounting step, the main body 41 is brought into contact with the contact surface 54*a* of the support portion 50 such that the support portion 50 is disposed between the main body 41 and the soundboard 16. Further, as shown in FIG. 8, the heads of the first fixing screws 91 are inserted into the respective head insertion holes 436A formed in the fixing plate portion 433 (the screw-fastening plate portions 436) of the main body 41.

In the first mounting step, the main body 41 is moved toward the contact surface 54*a* of the support portion 50 toward the positive side in the Z-axis direction in a state in which the main body 41 is held in contact with the guide surface 55*a* of the support portion 50. By permitting the main body 41 to be held in contact with the guide surface 55*a* of the support portion 50, the head insertion holes 436A of the main body 41 can be positioned so as to overlap the respective first fixing screws 91 in the axial direction thereof, i.e., the Z-axis direction.

In the present embodiment, the rails 58A extending in the axial direction of the first fixing screws 91 are formed on the guide surface 55*a* of the support portion 50, and the sliding portions 58B configured to slide in the longitudinal direction of the rails 58A are formed on the guided surface 435*a* of the main body 41 that contacts the guide surface 55*a*. It is thus possible, in the first mounting step, to move the main body 41 in the axial direction of the first fixing screws 91, i.e., the Z-axis direction, by the rails 58A and the sliding portions 58B.

In the first mounting step, the vibrating-side shaft portion 461 of the connecting unit 45 passes through the hole 434A (FIGS. 4 and 5) of the frame portion 431 (the engaging plate portion 434) of the main body 41, the insertion hole 420 of the magnetic-path forming portion 42, and a hole of the vibrating unit 44 attached to the magnetic-path forming portion 42 (FIG. 6).

In a state after the first mounting step has been performed, the engaging plate portion 434 of the main body 41 is in contact with the contact surface 54*a* of the support portion 50, but the shafts of the second fixing screws 92 are not yet inserted in the shaft insertion holes 434B formed in the engaging plate portion 434, as shown in FIG. 8. Further, the positioning protrusions 56A (the positioning engaging portions) formed on the contact surface 54*a* of the support portion 50 do not yet engage with the positioning holes 56B (the positioning engaged portions) formed in the engaging plate portion 434.

In the second mounting step, the main body 41 is moved with respect to the support portion 50 in the direction along the contact surface 54*a* (upward in FIG. 8) with the main body 41 held in contact with the contact surface 54*a* of the support portion 50, whereby the shafts of the first fixing screws 91 are inserted into the respective shaft insertion holes 436B from the respective head insertion holes 436A of the fixing plate portion 433, as shown in FIG. 3. At the same time, the positioning protrusions 56A of the support portion 50 are brought into engagement with or inserted into the respective positioning holes 56B of the main body 41, whereby the main body 41 is restricted from moving in the direction along the contact surface 54*a* with respect to the support portion 50.

In the second mounting step, the main body 41 is moved with respect to the support portion 50, whereby the shafts of the second fixing screws 92 are inserted into the respective shaft insertion holes 434B of the engaging plate portion 434.

In a state after the second mounting step has been performed, the fixing plate portion 433 (the screw-fastening plate portions 436) of the main body 41 is interposed between the heads of the first fixing screws 91 and the support portion 50 (the threaded plate portions 57), so that the fixing plate portion 433 of the main body 41 is supported by the heads of the first fixing screws 91. Further, the engaging plate portion 434 of the main body 41 is interposed between the heads of the second fixing screws 92 and the support portion 50 (the positioning plate portion 54), so that the engaging plate portion 434 of the main body 41 is supported by the heads of the second fixing screws 92. That is, the main body 41 is prevented from moving away from the support portion 50.

In particular, the contact surface 54*a* of the support portion 50 faces vertically downward (toward the negative side in the Z-axis direction), and the main body 41 is attached to the support portion 50 from the lower side of the support portion 50 in the vertical direction, so that the main body 41 is prevented from dropping in the state after the second mounting step has been performed.

In the state after the second mounting step has been performed, the positioning protrusions 56A of the support portion 50 are held in engagement with or fitted in the respective positioning holes 56B of the main body 41, so that the main body 41 can be easily positioned relative to the support portion 50.

In the third mounting step, the main body 41 is fastened to the support portion 50 by the first fixing screw 91 such that the fixing plate portion 433 (the screw-fastening plate portions 436) of the main body 41 is sandwiched between the support portion 50 (the threaded plate portions 57) and the heads of the first fixing screw 91. Further, in the third mounting step, the main body 41 is fastened to the support portion 50 by the second fixing screws 92 such that the engaging plate portion 434 of the main body 41 is sandwiched between the support portion 50 (the positioning plate portion 54) and the heads of the second fixing screws 92.

The main body 41 is fixed to the first fixing portion 52 of the support portion 50 by performing the first through third mounting steps.

In a period from after the second mounting step to after the third mounting step of the step of fixing the main body, the vibrating unit 44 of the vibrating portion 49 is fixed to the connecting unit 45. In this instance, the vibrating-side shaft portion 461 of the connecting unit 45 that has been inserted into the hole of the vibrating unit 44 in the first mounting step is preferably fixed to the vibrating unit 44 by the fixing means 440.

In the present embodiment, there is performed a step of attaching the cover member for attaching the cover member 70 to the second fixing portion 53 of the support portion 50 after all of the steps described above have been performed. Further, in a period from before the step of fixing the support portion to before the step of attaching the cover member, the third fixing screws 93 are screwed in the second fixing portion 53 of the support portion 50.

In the step of attaching the cover member, the cover member 70 is initially moved toward the support portion 50 from the lower side in the vertical direction, and the heads of the third fixing screws 93 are inserted into the respective head insertion holes 73A of the screw insertion holes 73 formed in the bottom plate portion of the cover member 70. The cover member 70 is subsequently moved toward the housing 11 (the back post 21), namely, toward the right side in FIG. 3, whereby the shafts of the third fixing screws 93 are inserted from the respective head insertion holes 73A of the screw insertion holes 73 into the respective shaft insertion holes 73B. Thus, the cover member 70 can be pressed onto the housing 11 with the second cushion members 82 interposed therebetween.

In this way, the acoustic transducer 40 is installed.

In the method explained above, the support portion 50 is positioned relative to the housing 11 and the intervening member 60 fixed to the soundboard 16, and is fixed to the housing 11. Further, the main body 41 of the acoustic transducer 40 is positioned relative to the support portion 50 by the contact surface 54*a* of the support portion 50 and the positioning protrusions 56A and the positioning holes 56B, and is fixed to the support portion 50. Consequently, the axis C1 of the magnetic-path forming portion 42, the axis C2 of the vibrating unit 44, the axis of the vibrating-side shaft portion 461 of the connecting unit 45, and the axis C3 of the vibrated-side shaft portion 462 can coincide with one another.

When a drive signal based on an audio signal is input to the voice coil 442 of the acoustic transducer 40 in the piano 1 on which the acoustic transducer 40 is installed, the vibrating unit 44 vibrates in the predetermined direction (the Z-axis direction). The vibration of the vibrating unit 44 is transmitted to the soundboard 16 by the connecting unit 45, so that the soundboard 16 vibrates in the predetermined direction. The vibration of the soundboard 16 propagates through the air, so that sounds are generated.

In an instance where the piano 1 on which the acoustic transducer 40 is installed undergoes displacement of the soundboard 16 in the orthogonal direction that is orthogonal to the predetermined direction due to deterioration over years, the intervening member 60 and the retainer portion 476 of the distal joint portion 472 that are fixed to the soundboard 16 are also displaced in the orthogonal direction with respect to the magnetic-path forming portion 42.

In the present embodiment, the connecting unit 45 includes the intermediate joint portion 471 and the distal joint portion 472. When the intervening member 60 and the retainer portion 476 of the distal joint portion 472 are displaced in the orthogonal direction, the axis C3 of the vibrated-side shaft portion 462 is inclined by the intermediate joint portion 471 and the distal joint portion 472 with respect to both of the predetermined direction and the axis C2 of the magnetic-path forming portion 42. It is consequently possible to prevent the axes of the vibrating unit 44 and the vibrating-side shaft portion 461 from being inclined with respect to the predetermined direction. In other words, it is possible to prevent the axis C2 of the vibrating unit 44 fixed to the vibrating-side shaft portion 461 from being inclined with respect to the axis C1 of the magnetic-path forming portion 42 that is parallel to the predetermined direction.

According to the installation structure for the acoustic transducer 40, the piano 1 including the same, and the method for installing the acoustic transducer 40, the shafts of the first fixing screws 91 screwed in advance in the support portion 50 are inserted into the shaft insertion holes 436B formed in the fixing plate portion 433 (the screw-fastening plate portions 436) of the main body 41, and the shafts of the second fixing screws 92 screwed in the support portion 50 in advance are inserted into the shaft insertion holes 434B formed in the engaging plate portion 434. Consequently, in a state before the main body 41 is fastened to the support portion 50 by the first and second fixing screws 91, 92, the fixing plate portion 433 (the screw-fastening plate portions 436) and the engaging plate portion 434 of the main body 41 are respectively supported by the first and second fixing screws 91, 92, whereby the main body 41 is prevented from moving away from the support portion 50. As a result, work for installing and replacing the acoustic transducers 40 can be facilitated.

In a state in which the shafts of the first and second fixing screws 91, 92 are fitted in the shaft insertion holes 436B, 434B, the positioning protrusions 56A of the support portion 50 are held in engagement with the positioning holes 56B of the main body 41, so that the main body 41 can be easily positioned with respect to the support portion 50. That is, the acoustic transducer 40 can be easily positioned with respect to the soundboard 16 at the same time when the acoustic transducer 40 is installed.

According to the present embodiment, when the heads of the first fixing screws 91 screwed in the support portion 50 are inserted into the head insertion holes 436A formed in the fixing plate portion 433 of the main body 41, the main body 41 is brought into contact with the guide surface 55*a* of the support portion 50, whereby the head insertion holes 436A of the main body 41 are positioned so as to overlap the respective first fixing screws 91 in the axial direction thereof (the Z-axis direction). Consequently, the heads of the first fixing screws 91 can be easily inserted into the respective head insertion holes 436A of the main body 41. That is, work for mounting the main body 41 on the support portion 50 can be facilitated.

According to the present embodiment, the rails 58A extending in the axial direction of the first fixing screws 91 are formed on the guide surface 55*a* of the support portion 50, and the sliding portions 58B to slide in the longitudinal direction of the rails 58A are formed on the guided surface 435*a* of the main body 41. It is consequently possible to prevent, with high reliability, the axis of each head insertion hole 436A formed in the fixing plate portion 433 of the main body 41 and the axis of each first fixing screws 91 from deviating relative to each other. It is thus possible to easily insert the heads of the first fixing screws 91 into the respective head insertion holes 436A of the main body 41.

According to the installation structure for the acoustic transducer 40 and the piano 1 including the same, the base plate portion 51 of the support portion 50 is held in surface contact with the housing 11 so as to be fixed thereto. It is thus possible to prevent the base plate portion 51 from being vibrated even if the first fixing portion 52 of the support portion 50 is vibrated due to vibration of the vibrating portion 49 of the acoustic transducer 40. Further, the second fixing portion 53 of the support portion 50 is connected to the base plate portion 51 independently of the first fixing portion 52, whereby vibration of the first fixing portion 52 is prevented from being transmitted to the second fixing portion 53. In other words, the cover member 70 fixed to the second fixing portion 53 is prevented from being vibrated due to vibration of the vibrating portion 49. Consequently, sounds generated from the soundboard 16 that is vibrated by the acoustic transducer 40 can be suitably obtained.

According to the present embodiment, the first cushion members 81 that are elastically deformable are interposed between the cover member 70 and the second fixing portion 53. Even if the second fixing portion 53 is vibrated due to vibration of the vibrating portion 49, the first cushion members 81 are elastically deformed, whereby it is possible to prevent vibration of the second fixing portion 53 from being transmitted to the cover member 70.

According to the present embodiment, the cover member 70 is pressed onto the housing 11 via the second cushion members 82 that are elastically deformable. Even if vibration of the vibrating portion 49 is transmitted to the cover member 70, the second cushion members 82 are elastically deformed, whereby it is possible to prevent the cover member 70 from being vibrated.

While the embodiment of the present invention has been explained, it is to be understood that the invention is not limited to the details of the illustrated embodiment, but may be embodied with various other changes without departing from the scope of the invention defined in the attached claims.

For instance, each positioning engaging portion of the support portion 50 configured to position the main body 41 relative to the support portion 50 may be a positioning recess that is recessed from the contact surface 54*a* of the positioning plate portion 54. In this case, the engaging plate portion 434 of the main body 41 is preferably provided with a positioning protrusion, as the positioning engaged portion, which is formed so as to protrude from the contacted surface 434*c* of the engaging plate portion 434 and configured to be inserted into the positioning recess.

The joint portion 47 of the connecting unit 45 may be constituted by only one of the intermediate joint portion 471 and the distal joint portion 472. In an instance where the joint portion 47 is constituted only by the distal joint portion 472, the shaft portion 46 of the connecting unit 45 is preferably formed so as to extend from the vibrating unit 44 to the soundboard 16, as in the illustrated embodiment. In this instance, the distal joint portion 472 allows the entirety of the shaft portion 46 to incline with respect to the predetermined direction (the Z-axis direction).

The joint portion 47 of the connecting unit 45 may have any structure other than the ball-joint structure in the illustrated embodiment. For instance, the joint portion 47 may have a universal joint structure.

The connecting unit 45 may be constituted only by the shaft portion 46 without the joint portion 47.

In the illustrated embodiment, the magnetic-path forming portion 42 is fixed to the fixing plate portion 433 such that the vibrating unit 44 is located near to the fixing plate portion 433 of the restricting holder portion 43. The magnetic-path forming portion 42 may be fixed otherwise. For instance, the magnetic-path forming portion 42 may be fixed to the fixing plate portion 433 such that the vibrating unit 44 is located near to the engaging plate portion 434 of the restricting holder portion 43. In this case, the vibrating portion 49 may be configured not to have the connecting unit 45 and to have only the vibrating unit 44, and the vibrating unit 44 may be detachably connected to the intervening member 60.

The present installation structure for the acoustic transducer 40 may be configured not to have the intervening member 60, for instance. In this case, it is preferable to connect the vibrating portion 49 directly to the soundboard 16.

When the acoustic transducer 40 is installed in an instance in which the connecting unit 45 is undetachably fixed to the vibrating unit 44 or in an instance in which the vibrating portion 49 does not include the connecting unit 45, it is preferable to fix the vibrating portion 49 to the soundboard 16 after the step of fixing the support portion and the step of fixing the main body in the illustrated embodiment have been performed.

The support portion 50 for supporting the acoustic transducer 40 may be fixed to the outer rim 19 or the inner rim 20, other than the back post 21 of the housing 11.

The soundboard 16 is illustrated as one example of the vibrated body which is to be vibrated and on which the acoustic transducer 40 is installed. The vibrated body may be other members of the housing 11 that may undergo displacement due to deterioration over years, for instance.

The acoustic transducer 40 can be installed in a structure in which the vibrated body does not undergo displacement and the member of the housing 11 to which the magnetic-path forming portion 42 is fixed may undergo displacement due to deterioration over years.

The acoustic transducer 40 is applicable to musical instruments having the vibrated body such as the soundboard 16. For instance, the acoustic transducer 40 is applicable to various musical instruments such as other keyboard musical instruments such as upright pianos, stringed musical instruments such as acoustic guitars and violins, percussion instruments such as drums and timpani, and electronic musical instruments such as electronic pianos.

What is claimed is:

1. An installation structure for an acoustic transducer configured to vibrate a vibrated body of a musical instrument in a first direction so as to permit the vibrated body to generate sounds, comprising:

the acoustic transducer having a main body and a vibrating portion configured to vibrate in the first direction with respect to the main body;

a support portion to be fixed to a housing of the musical instrument so as to support the main body of the acoustic transducer; and a cover member fixed to the support portion so as to cover the acoustic transducer, wherein the support portion includes a base plate portion to be held in surface contact with the housing so as to be fixed thereto, a first fixing portion to which the main body of the acoustic transducer is fixed and which is configured to support the main body, and a second fixing portion to which the cover member is fixed, and wherein the first fixing portion and the second fixing portion are connected to the base plate portion independently of each other.

2. The installation structure for the acoustic transducer according to claim 1, wherein an elastically deformable cushion member is interposed between the cover member and the second fixing portion.

3. The installation structure for the acoustic transducer according to claim 1, wherein the cover member is configured to be pressed onto the housing.

4. The installation structure for the acoustic transducer according to claim 1, wherein the first fixing portion and the second fixing portion extend from the base plate portion in a second direction intersecting the first direction so as to form a space therebetween.

5. The installation structure for the acoustic transducer according to claim 4, wherein the first fixing portion extends, in the second direction, from a first position of the base plate portion, and wherein the second fixing portion extends, in the second direction, from a second position of the base plate portion different from the first position.

6. The installation structure for the acoustic transducer according to claim 5, wherein the first position and the second position of the base plate portion are different from each other.

7. The installation structure for the acoustic transducer according to claim 5, wherein the second direction is a direction away from a surface of the base plate portion that is to be held in contact with the housing.

8. The installation structure for the acoustic transducer according to claim 1, wherein the acoustic transducer is configured to be installed on an exterior portion of the musical instrument.

9. A musical instrument, comprising:

a vibrated body;

an acoustic transducer configured to vibrate the vibrated body in a first direction so as to permit the vibrated body to generate sounds, the acoustic transducer having a main body and a vibrating portion configured to vibrate in the first direction with respect to the main body;

an installation structure for the acoustic transducer; and a housing; and wherein the installation structure includes a support portion fixed to the housing so as to support the main body of the acoustic transducer, and a cover member fixed to the support portion so as to cover the acoustic transducer;

wherein the support portion includes a base plate portion to be held in surface contact with the housing so as to be fixed thereto, a first fixing portion to which the main body of the acoustic transducer is fixed and which is configured to support the main body, and a second fixing portion to which the cover member is fixed; and wherein the first fixing portion and the second fixing portion are connected to the base plate portion independently of each other.

* * * * *